United States Patent [19]

Gruber et al.

[11] 4,303,749

[45] Dec. 1, 1981

[54] SINGLE COMPONENT MAGNETIC TONER WITH EPOXY RESIN

[75] Inventors: Robert J. Gruber, Pittsford; Steven B. Bolte, Webster, both of N.Y.

[73] Assignee: Xerox Corporation, Stamford, Conn.

[21] Appl. No.: 200,708

[22] Filed: Oct. 27, 1980

[51] Int. Cl.[3] ..... G03G 13/22; G03G 19/00

[52] U.S. Cl. ..... 430/39; 430/107; 430/109; 430/110; 430/122; 430/903; 430/126

[58] Field of Search ..... 430/107, 108, 120, 122, 430/903, 126, 39, 109, 110

[56] References Cited

U.S. PATENT DOCUMENTS

| | | | |
|---|---|---|---|
| 4,105,572 | 8/1978 | Gorondy | 430/106 |
| 4,176,078 | 11/1979 | Lu | 430/109 |
| 4,192,902 | 3/1980 | Lu | 430/107 X |
| 4,218,530 | 8/1980 | Lu | 430/107 |
| 4,230,787 | 10/1980 | Watanabe et al. | 430/107 |

FOREIGN PATENT DOCUMENTS

| | | | |
|---|---|---|---|
| 2725963 | 12/1977 | Fed. Rep. of Germany | 430/107 |
| 54-155049 | 12/1979 | Japan | 430/122 |

*Primary Examiner*—Roland E. Martin, Jr.
*Attorney, Agent, or Firm*—E. O. Palazzo

[57] ABSTRACT

This invention relates to a single component magnetic tone containing an epoxy resin and a magnetic pigment, particularly iron oxide pigments, which have been treated with surface reactive coupling materials, selected from organic titanates and lechithin, which treatment results in a magnetic toner where the melt flow temperature of such a toner is below 110° C., and preferably between about 90° C. and 105° C. Also described is a method for the development of magnetic images which involves causing the formation of a magnetic latent image on a magnetizable recording medium, developing the image with the above toner, followed by transferring the image to a suitable substrate, and subsequently permanently fusing the image to said substrate by heat.

6 Claims, No Drawings

SINGLE COMPONENT MAGNETIC TONER WITH EPOXY RESIN

BACKGROUND OF THE INVENTION

This invention relates generally to new toner compositions, and more specifically, to single component magnetic toners, wherein the magnetic component is treated with organic coupling materials, thereby, in one embodiment, reducing the fusing energy of the resulting toner.

In the electrophotographic process, especially the xerographic process, and in magnetic imaging systems similar steps are involved in causing the formation and development of images, including for example the formation of a latent image, the development of the latent image with a developing composition containing toner, optionally transferring the developed image to a suitable support such as paper, fusing the image to the paper substrate using a number of known techniques, including those employing heat, and optionally cleaning the surface from which the developed latent image has been transferred. In the xerographic process, the photoconductive surface or plate which contains an electrostatic latent image can be developed by means of a variety of pigmented resin materials specifically made for this purpose, such as toners. The toner material is electrostatically attracted to the latent image on the plate in proportion to the charge concentration thereon. These toner materials can be applied by a number of known techniques including for example, cascade development, see U.S. Pat. No. 3,618,552, magnetic brush development, see U.S. Pat. No. 2,874,063, and touchdown development, see U.S. Pat. No. 3,166,432. The developed image is then transferred to a suitable substrate such as paper, and can be fixed by using a number of different techniques including for example vapor fixing, heat fixing, pressure fixing or combinations thereof as described for example in U.S. Pat. No. 3,539,161.

In magnetic imaging systems substantially the same process steps are involved as described above with respect to electrophotographic imaging systems, thus there is formed a latent magnetic image on a magnetizable recording medium, which image can be used in duplicating processes, for example, by repetitive toning and transfer of the developed image. The latent magnetic image is formed by any suitable magnetization procedure whereby a magnetized layer of marking material is magnetized, and such magnetism transferred imagewise to the magnetic substrate; or where the magnetization pattern is applied directly to the magnetic substrate by a record head, or similar device. The latent magnetic image can be developed with a magnetic developer usually toner with a magnetic pigment to render such image visible. The developed visible magnetic image can then be typically transferred to a receiver such as for example a sheet of paper, which image is fused on the paper in order to produce a final copy or print referred to in the art as a hard copy.

One method of developing magnetic images is referred to as magnetic toner touchdown development, which involves providing a substantially uniform layer of toner comprising magnetic material on a conductive substrate, which material can be brought either closely adjacent to that of the image or in contact with the image. The magnetic material in the toner acts as an extension of the conductive backing and therefore acquires charge, induced therein by the latent image of a polarity opposite to that of the latent image. The conductive substrate can be biased to assist in transfer of the toner to the latent image, however, a conductive backing is not essential.

Typical suitable fusing methods that may be used have been described in the prior art and include for example, heating the toner and the developed image to cause the resins thereof to at least partially melt, and become adhered to the photoconductor binder member, or copy substrate, in the case of images transferred from the imaging media followed by the application of pressure to the toner with heating such as the use of a heated roller. Solvent or solvent vapor fusing has also been used, wherein the resin component of the toner is partially dissolved. The photoconductor binder member or copy substrate is typically of sufficient hardness to allow fixing solely by the application of pressure such as for example by a contact roller and in an amount sufficient to calender the toner.

Interest in magnetic toners, and more specifically, single development toners, that is, toners that do not contain carrier materials has increased rather significantly over the past several years. However, in many instances, such toners, particularly those containing certain magnetic pigments, possess a high fusing temperature thereby adversely affecting the imaging material over a period of time. Reducing the fusing temperature of the toner will result in a reduction in the amount of energy that is required to fuse the toner to the substrate such as paper, and thus allow the production of better quality images over longer periods of time.

SUMMARY OF THE INVENTION

It is an object of this invention to provide single component magnetic toners and a process for preparing such toners which overcome the above disadvantages.

Another object of the present invention relates to the treatment of pigments such as iron oxides with organic coupling agents for the purpose of reducing the fusing energy of toners containing such oxides.

Another object of the present invention is the provision of single component magnetic toners containing epoxy resins, which toners are useful, for developing magnetic images.

These and other objects of the present invention are accomplished by providing a single component magnetic toner containing an epoxy resin and a magnetic pigment, particularly iron oxide pigments, which have been treated with surface reactive coupling materials, selected from organic titanates and lechithin, which treatment results in a magnetic toner where the melt flow temperature of such a toner is below 110° C., and preferably between about 90° C. and 105° C., thus resulting in a toner that requires less energy to fix than typical known toners such as those containing epoxy resins containing iron oxides that have not been treated with the coupling agents of the present invention. Such toners not treated in accordance with the present invention possess higher melt flow temperatures, for example 130° C. and above.

The reactive coupling agents utilized in the present invention include organic titanates commercially available from Kenrich Petrochemical Inc., Bayonne, New Jersey, and identified as Ken-Reacts, KR-46B, KR-38S, KR-134S, KR-44, and KR138S, and Lecithin, commercially available from Central Soya, Inc., Wayne, Indiana, such as Centiocap 162US, and Centrol 3F-UB.

The amount of reactive coupling agents utilized ranges from about 0.1 percent to about 5 percent and preferably from about 1 percent to about 2 percent, however, amounts outside these ranges can be employed so long as they do not adversely affect the melt fusing temperature of the resulting toner.

Illustrative examples of magnetic pigments that may be treated in accordance with the present invention include magnetites like iron oxides, such as $Fe_3O_4$,-$Fe_2O_3$, ferrites, nickel alloys, and the like. Some of these materials are commercially available and are identified as MO-4232, which is a magnetite commercially available from Pfizer Pigment Co., New York, New York, K-378, which is a magnetite commercially available from Northern Pigments Company, Toronto, Can., Ontario, or Mapico black which is a magnetite commercially available from Columbia Division, Cities Services, Inc., Akron, Ohio. The amount of magnetic material present ranges from about 40 percent to about 70 percent by weight, and preferablyfrom about 50 percent to about 65 percent by weight. The total amount of magnetic material plus resin is equal to about 100 percent. Thus, when 70 percent by weight of the magnetic material is present, 30 percent by weight of the resin is present.

The treated magnetic pigments when mixed with epoxy resins, can be used as toners for developing images in either electrophotographic systems or magnetic imaging systems. No carrier is employed when such materials are used in these development systems and therefore they can be referred to as single component developers. In one magnetic imaging system a magnetic latent image is formed on a suitable substrate followed by contacting the image with the toner comprised of a resin and a magnetic material treated with an organic coupling agent followed by transferring the developed image to a suitable substrate and permanently affixing the image thereto by fusing.

Epoxy resins utilized in the present invention include various resins which are commercially available, and identified for example as Shell EPON 1004, Shell EPON 1007, and Shell EPON 1010.

The toners of the present invention are prepared by methods known in the art, including for example, melt blending of the components, toner resin and treated magnetic pigment, followed by mechanical attrition thereby producing toners having a particle size of from about 10 to about 30 microns.

The following examples are being supplied to further define the specifics of the present invention, it being noted that these examples are intended to illustrate and not limit the scope of the invention. Parts and percentages are by weight unless otherwise indicated.

The flow temperature of the toner of the present invention was measured utilizing thermal mechanical analysis equipment. In one illustrative example the measurement was accomplished as follows:

A thermal mechanical analysis (TMA) device consisting of a Perkin Elmer Thermomechanical System (TMS-1) which has a sample chamber surrounded by a thermostated oven, a glass probe (with flat bottom surface, expansion probe), a unit for measuring probe deflection and a recorder was used. The temperature of the device was programmed at 20° C./min. using a Perkin Elmer Temperature Program Control Unit (UU-1). The temperature within the sample chamber was monitored using a Chromel-Alumel thermocouple connected in series with an Omega-CJ cold junction compensator and an Omega thermal coupler amplifier (both from Omega Engineering, Stamford, Conn.). The temperature output from the thermal coupler amplifier was used to drive a Hewlett-Packard recorder (7044A x-y Recorder). Temperature readout was obtained by connecting the thermal coupler amplifier to a Doric Integrating Microvoltometer.

In a typical experiment, an approximately 80 mg. toner sample pellet was placed on the flat glass surface of the sample chamber. Tiny asperities formed during molding were previously removed from the edges of the pellet to ensure maximum contact between the pellet and the glass surface of the sample chamber and between the pellet and the glass probe's flat bottom surface. The TMS-1 deflection output was synchronized with the recorder deflection output by zeroing the recorder, as well as the TMS-1. The pellet surface position was indicated on the recorder paper. The sample pellet was then removed and the probe was allowed to rest on the bottom of the sample chamber. This position was also indicated on the recorder paper. The difference between these two positions was a measurement of pellet height. (The pellet height axis can be calibrated using standards of known heights.) The pellet was again placed in the sample chamber. When the glass probe again rested on the pellet surface with maximum contact, the recorder position was the same as that previously determined.

For satisfactorily zeroed samples the heating unit was placed around the sample chamber. When the sample chamber temperature reached 25.0° C., the temperature programmer (at 20° C./min.) and the recorder were started simultaneously. As the temperature increased the top surface of the pellet was monitored, then a large deflection was noted and finally the bottom of the pellet (or surface of the sample chamber) was monitored. When additional weight on the probe did not cause deflection, the bottom surface was reached and the sample was removed by solvent washing. The temperature at which the probe penetrated halfway through the sample was recorded as the flow temperature ($T_f$).

EXAMPLE I

Pfizer Chemical Company MO-4232, an iron oxide magnetic pigment 100 parts by weight, and hexane 550 parts containing the organic coupling agent Centiocap 162 US, commercially available from Central Soya, Inc., a phosphorus containing material, 2 percent by weight based on the weight of iron oxide was rapidly stirred in a Waring Blendor for about 8 minutes. The resultant mixture, which initially was granular in appearance became homogeneous after treatment. Subsequently, this mixture was filtered and washed extensively primarily for the purpose of removing any excess coupling agent, with 1 liter of hexane, and dried. Elemental analysis showed a high level of phosphorus, namely 264 parts per million, indicating that the coupling agent was "sorbed" on the surface of the iron oxide.

EXAMPLE II

There was prepared by melt blending followed by mechanical attrition, a toner containing 65 percent by weight of the treated iron oxide pigment of Example I, and 35 percent by weight of the epoxy resin, EPON 1004, commercially available from Shell Chemical Company. This toner had a melt flow temperature of 105° C.

When such a toner is used to develop magnetic images in a magnetic imaging system, images of excellent quality, and high resolution result.

EXAMPLE III

The procedure of Example II is repeated with the exception that the toner contained 50 percent by weight of the treated iron oxide pigment, and 50 percent by weight of the epoxy resin. This toner has a melt flow temperature 101° C. When such a toner is used to develop magnetic images in a magnetic imaging system, images of excellent quality, and high resolution result.

The toners of the present invention can be used to develop images in magnetic imaging systems, in accordance with the process as discussed herein, reference for example Page 1.

EXAMPLE IV

The procedure of Example II was repeated with the exception that the epoxy resin, EPON 1004 was not treated with the iron oxide pigment of Example I. There resulted a toner having a melt flow temperature of 130° C.

Other modifications of the present invention will occur to those skilled in the art upon a reading of the present disclosure. These are intended to be included within the scope of this invention.

What is claimed is:

1. A single component magnetic toner, containing from about 30 percent to about 60 percent by weight of an epoxy resin, and from about 40 percent to about 70 percent by weight of a magnetic pigment treated with an organic titanate or lecithin reactive coupling agent, said toner having a melt flow temperature of from about 90° C., to about 110° C.

2. A method for causing the development of magnetic images utilizing a single component magnetic toner, which comprises the formation of a magnetic latent image on a magnetizable recording medium, followed by developing the image with a single component toner containing an epoxy resin in an amount of from about 30 percent to about 60 percent by weight, and an iron oxide magnetic pigment present in an amount of from about 40 percent to about 70 percent by weight, which iron oxide has been treated with an organic titanate or lecithin reactive coupling agent, said toner having a melt flow temperature of from about 90° C. to about 110° C., followed by transferring the image to a suitable substrate, and subsequently permanently fusing the image to said substrate by heat.

3. A toner in accordance with claim 1 wherein the magnetic pigment is an iron oxide, or mixtures of said iron oxides.

4. A toner in accordance with claim 3 wherein from about 40 to about 70 percent by weight of iron oxide is present, and about 30 to about 60 percent by weight of epoxy resin is present.

5. A toner in accordance with claim 1 wherein the reactive coupling agent is an organic titanate.

6. A toner in accordance with claim 1 wherein the reactive coupling agent is lecithin.

* * * * *